United States Patent [19]

Saunders

[11] Patent Number: 4,576,305

[45] Date of Patent: Mar. 18, 1986

[54] SHEET METAL WALL PANEL AND INTEGRAL OPENER STRUCTURE

[75] Inventor: William T. Saunders, Weirton, W. Va.

[73] Assignee: Weirton Steel Corporation, Weirton, W. Va.

[21] Appl. No.: 736,080

[22] Filed: May 20, 1985

[51] Int. Cl.[4] ..... B65D 17/34

[52] U.S. Cl. ..... 220/269

[58] Field of Search ..... 220/269, 270, 271, 272, 220/273; 413/12

[56] References Cited

U.S. PATENT DOCUMENTS

| | | | |
|---|---|---|---|
| 4,399,925 | 8/1983 | Fundom | 220/269 |
| 4,416,389 | 11/1983 | Wilkinson et al. | 220/269 |
| 4,417,668 | 11/1983 | Stolle | 220/269 |
| 4,491,236 | 1/1985 | Kawamata | 220/269 |

*Primary Examiner*—George T. Hall

*Attorney, Agent, or Firm*—Raymond N. Baker

[57] ABSTRACT

Convenience feature wall panel (36) and integral opener (52) structure providing Class 1 and Class 2 lever action severance of scored sheet metal. In a beverage can embodiment, a U-shaped tab (40) positioned on the can end wall with its closed end contiguous to peripheral chime seam metal (32) is moved from the original contour of the wall panel to provide a pour opening (94). The movable tab, along with the integrally attached opener, is retained by sheet metal at the open end (46) of the U-shaped movable tab which is unitary with the remainder of the wall panel. Profiling formed in the movable tab sheet metal presents longitudinally-extending reinforcing rib means (53, 54, 55, 56) with a transverse portion (58) of the movable tab which is free of longitudinally-extending rib means providing for folding of longitudinal sections (90, 92) of the movable tab in overlaying relationship to each other and a portion of such remainder of the wall panel as the movable tab and integral opener are stored externally of the can out of the way of the pour opening.

20 Claims, 10 Drawing Figures

FIG. 1 PRIOR ART
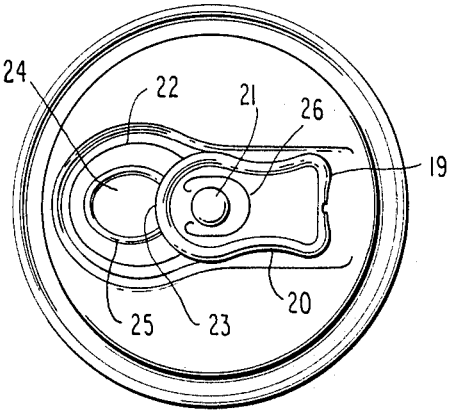
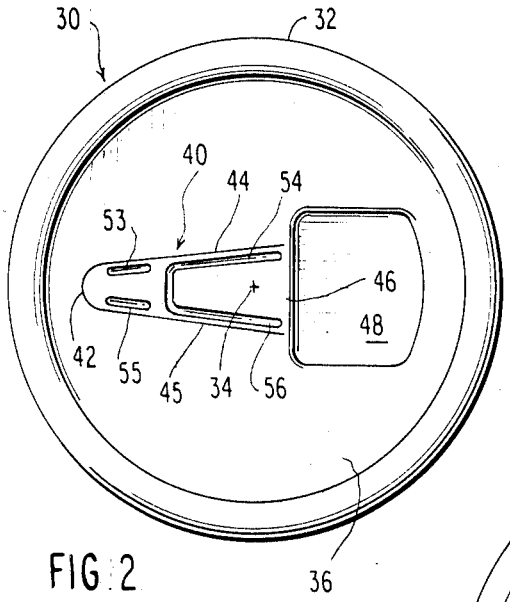
FIG. 2
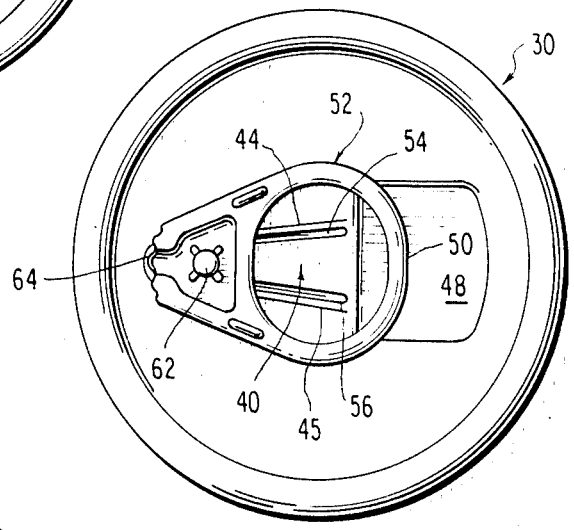
FIG. 3
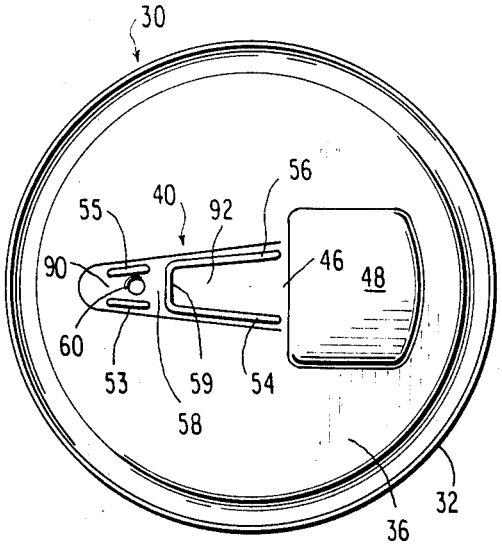
FIG. 4

FIG. 9
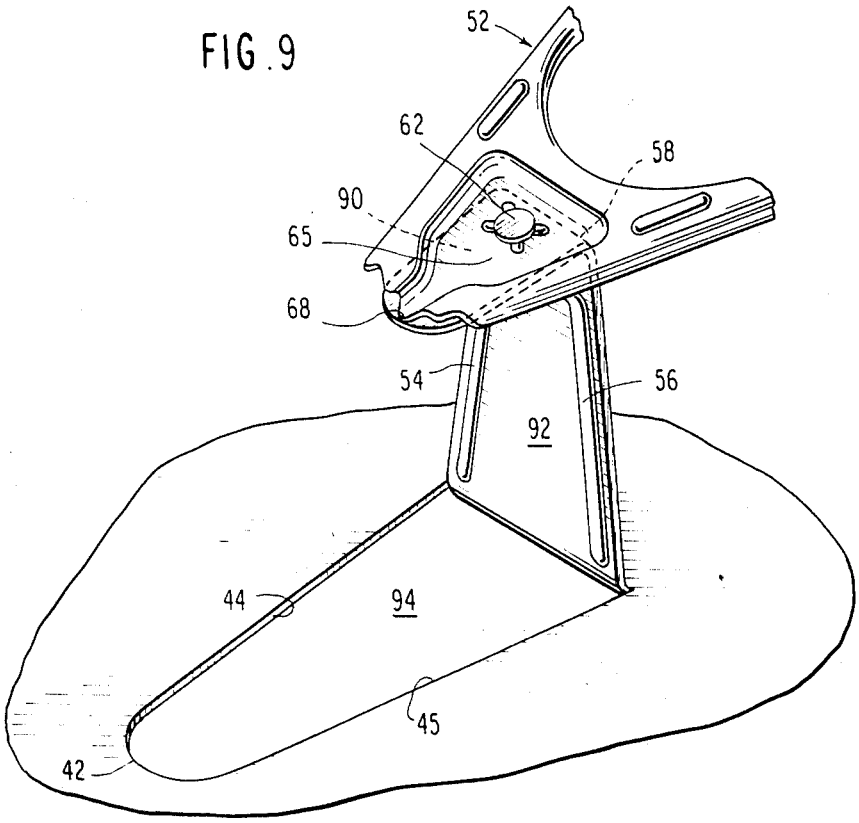
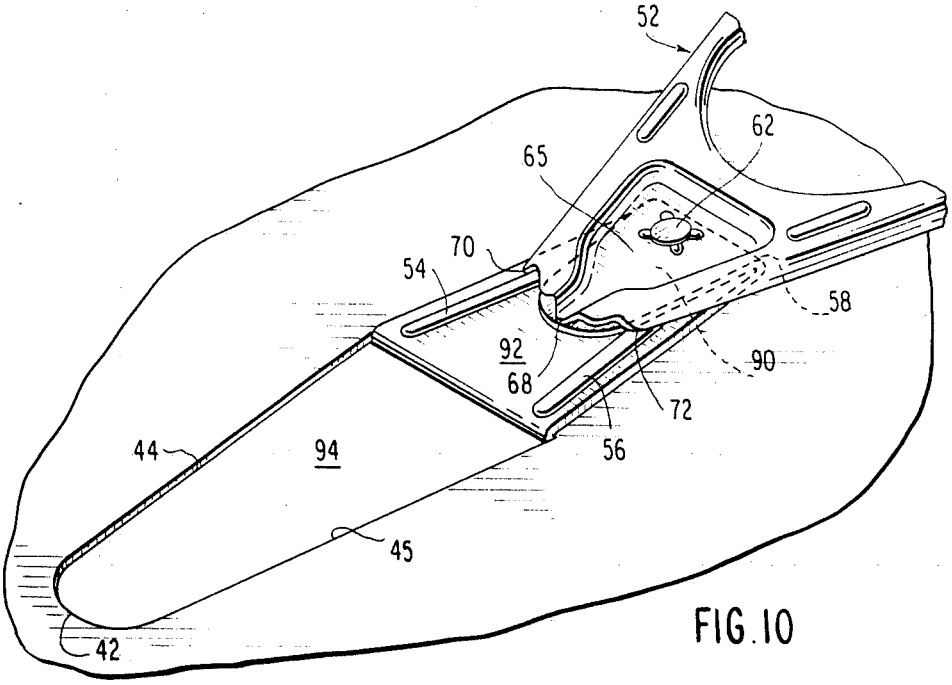
FIG. 10

SHEET METAL WALL PANEL AND INTEGRAL OPENER STRUCTURE

This invention relates to convenience feature opening of a sheet metal wall panel for a can. More particularly, this invention is concerned with structure providing for combined Class 1 and Class 2 lever action severance of scored metal to provide a tear strip movable from a sheet metal wall panel to form an opening.

Prior art easy-open structures, e.g. for beverage cans, include a so-called "pop top" type in which a portion of a scored tab in a sheet metal end wall panel is initially ruptured by Class 2 lever action and then the tab is torn in an external direction from the panel, a "tape sealed" type in which metal foil laminated with adhesive covers a small pour opening in a sheet metal end wall of a can for non-carbonated beverages, such as tomato juice, and a "retained tab" type in which severed sheet metal is pushed to the interior of the can by an integral opener which is retained on the wall panel.

Use of "pop top" end wall structure has been banned in many jurisdictions because of non-degradable litter problems; such "pop top" structures having been formed from aluminum. The "tape sealed" convenience feature, while applicable to cans made from flat-rolled steel, has been objected to because of insufficient protection against tampering. A non-integral supplemental tool has been proposed for the currently used "retained-tab" structure and use of flat-rolled steel can stock in place of aluminum has not been commercially practical with such retained-tab structure.

The present invention overcomes such objectionable aspects of the prior art. Fabrication and structure are taught utilizing novel configurational and dispositional relationships of sheet metal scoreline means, sheet metal reinforcing means, integral opener structure and opener securing means. Sequential Class 1 and Class 2 lever action are provided which facilitate ease of severance of scored sheet metal. With such teachings, easy opening of sheet metal wall panels, including wall panels made from flat-rolled steel, is readily available.

An end wall closure embodiment of the invention provides for retention of a sheet metal tab and integral opener on a beverage can under more sanitary conditions than currently available with retained-tab carbonated beverage cans which place the retained sheet metal on the inside of the can in contact with the beverage; in accordance with the invention, a movable tab and integral opener are retained and stored externally of the can out of the way of the pour opening provided.

Another feature of the end wall embodiment of the invention is the provision of a pour opening for a beverage can end wall which allows easy access of air to the interior of the can to facilitate smooth flow throughout dispensing of liquid contents.

These and other features, advantages and contributions of the invention are considered in more detail in describing structure shown in the accompanying drawings; in these drawings:

FIG. 1 is a top plan view of prior art easy-open retained tab structure for a beverage can;

FIG. 2 is a top plan view of an end wall panel embodiment showing scoreline and profiling features of the present invention before placement of an integral tab opener;

FIG. 3 is a top plan view of structure using features of the embodiment of FIG. 2 with the tab opener of the present invention secured in place by a unitary rivet;

FIG. 4 is a bottom plan view of the embodiment of FIG. 3 for showing the location of a unitary rivet button for securing the tab opener to the movable tab in accordance with the invention;

FIG. 9 is a perspective view showing a sequential opening stage to that of FIG. 8; and FIG. 10 is a perspective view showing storage of the movable tab and integral opener on the exterior surface of a wall panel in accordance with the invention.

Figure 6:
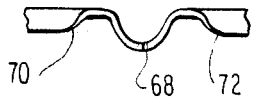
FIG. 6 is an elevational view of the working end of the tab opener of FIG. 5.

In the retained-tab opening structure shown in FIG. 1 which is currently in use commercially for carbonated beverages, a lifting action at the handle (input) end 19 of opener 20 causes pivoting about rivet 21. The rivet acts as the fulcrum for the Class 1 lever action and rupturing along scoreline 22 occurs through the force applied by working end 23 of the opener 20 against an inner portion of tab 24. This force is extended to the periphery of tab 24 partially through sheet metal reinforcing means in the form of curvilinear profile rib 25.

The length of opener 20 is limited by the positioning required which limits the lever-action mechanical advantage available. Also, some of the mechanical advantage is lost because severing of the scoreline must occur remote from where the force is applied to movable tab 24; this, in effect, lengthens the working arm of the lever.

The opener 20 is lanced at line 26 about rivet 21 to facilitate initial lifting of input end 19 by decreasing back tension in the sheet metal of the opener. By continued lifting of end 19 of opener 20 (in a direction away from the external surface of the wall panel) through an arc of approximately 180° tab 24 is pushed to the inside of the can; then opener 20 is returned to approximately its original position.

One objection which has been raised in relation to the structure of FIG. 1 is that the full external surface of the movable tab, which may be heavily contaminated, is positioned inside the can in full contact with the beverage and that at least partial contact continues until the beverage is substantially completely removed. Also, the above described prior art structure can be difficult to open notwithstanding use of such sheet metals as aluminum and aluminum alloys for its manufacture.

The present invention teaches new configurational and dispositional aspects for sheet metal opening structure which increase the mechanical advantage available enabling easy opening of sheet metal can stocks including flat-rolled steel, which provide for full utilization of available mechanical advantage, which enable initial rupture and scoreline severance to take place by Class 1 and Class 2 lever action and which provide for storage of a beverage can retained tab (and opener) externally of the can out of the way of the pour opening provided.

The embodiment of FIG. 2 is shown free of a tab opener or any means for holding an opener integrally with the panel for purposes of describing scoreline and profiling features utilized in carrying out the invention. An end wall closure 30 is shown with peripheral chime seam metal 32 symmetrically disposed in relation to the geometric center 34 of wall panel 36. The sheet metal in a selected wall panel for a can is scored to provide residual metal of predetermined thickness and define the major portion of a tear strip to be moved from the contour of the wall panel. An opener is made integral with the sheet metal of such tear strip by securing means known in the art, such as a unitary rivet.

In providing a pour opening for a beverage can end wall closure as shown in FIG. 2, the major peripheral portion of an elongated generally U-shaped tear strip 40 is defined by scoreline means which include an arcuate-shaped scoreline 42 and a pair of elongated scoreline legs 44, 45. A scoreline leg extends from each side of arcuate scoreline 42 to provide a relatively narrow-width elongated tab with its lateral sides extending from such curvilinear closed end, defined by arcuate scoreline 42, toward the remaining open end of the U-shaped configuration.

The rectilinear scoreline legs, as shown, diverge slightly in extending from the arcuate scoreline but can be parallel; also, the scoreline legs can be slightly curvilinear in configuration while maintaining the elongated characteristic of the tear strip and the opener straddle feature described later.

The distal ends of elongated scoreline legs 44, 45 terminate at the remaining end 46 of the U-shaped configuration so that tab 40, while movable from the original contour of the wall panel 36, remains unitary with the remainder of the wall panel at such open end 46 of the U-shaped configuration. Indentation 48 at such open end 46 is located beneath handle end 50 (as seen in FIG. 3) of a tab opener 52; indentation 48 improves finger access for initial lifting of the handle end 50 in a direction away from the external surface of panel 36.

Shallow-depth profiling in the defined tear strip provides reinforcing for the sheet metal of the movable tab. Such profiling is strategically placed within the scored periphery of tab 40 to help establish separate longitudinal sections for the movable tab and to help achieve the desired coaction between the tab opener, such longitudinal sections of the tab, and portions of the scoreline means. Such profiling also helps to provide, after initial rupture, for continued lever action rupturing of scoreline residual metal as well as a sequential pull-back fold-down action for the end wall movable tab which provides for storage of the movable tab and integral opener on the exterior of the can out of the way of the pour opening provided.

As taught by the invention, sheet metal reinforcing means extend longitudinally of the movable tab while providing a portion of the tab (transverse to its central longitudinal axis) which is free of longitudinally-extending reinforcing means. For example, longitudinally-extending rib means can be interrupted along the length of the tab to provide a portion of the tab which is free of longitudinally-extending reinforcing means; such transverse portion facilitates folding of longitudinal sections of the tab in relation to each other during opening and storage as described in relation to later figures.

In a preferred embodiment of such longitudinally-extending reinforcing means, as best seen in FIGS. 2 and 4, individual profile ribs 53, 54 extend along and are contiguous to scoreline leg 44 within the periphery of tab 40; and, individual ribs 55, 56 extend along and are contiguous to scoreline leg 45 within the periphery of tab 40. Transverse portion 58 (FIG. 4) is contiguous to the unitary rivet means and is free of longitudinally-extending rib means. Transverse portion 58 can include a laterally-directed rib 59 extending between individual ribs 54, 56.

Placement of the unitary rivet means and the transverse portion which is free of linearly-extended reinforcing means is selected to provide for desired folding of the tab sheet metal which typically takes place about $\frac{1}{3}$ of the distance from the curvilinear closed end of the tab toward the remaining longitudinally-opposite open end of the tab.

Placement of rivet button 60 for securing the opener to the movable tab locates the fulcrum for initial lever action. A small diameter unitary rivet button, available through use of flat-rolled steel, enables desired placement of the initial lever-action fulcrum contiguous to the working end of the opener.

As shown in FIGS. 3 and 4, tab opener 52 is held integrally with the sheet metal of movable tab 40 by unitary rivet head 62. Working end 64 of tab opener 52 is in place over the closed end of the movable tab 40 at arcuate scoreline 42 and handle (input) end 50 extends over access indentation 48. The tab opener securing means is positioned to be in the longitudinal section of U-shaped tab 40 at its closed end. As best seen in FIG. 4, the unitary rivet button is located between reinforcing ribs 53, 55 contiguous to transverse portion 58.

For assembly purposes of a unitary rivet, a panel portion 65 of tab opener 52 is provided with a rivet button aperture 66 (FIG. 5) for receiving rivet button 60 which is then flattened to form rivet head 62 (FIG. 3) making the tab opener 52 integral with tab 40.

The scoreline means, the sheet metal reinforcing means and the location of the tab opener securing means are positioned in relation to each other to carry out concepts of the invention which facilitate manufacture, ease of opening and storage.

Unitary rivet means are used for securing the opener to the tab; for such purposes, a unitary rivet button is formed initially at a predetermined location in the wall panel. Scoring the metal to define the tear strip and profiling of the tear strip are then carried out substantially simultaneously; or such sheet metal reinforcement profiling is carried out in closely following sequence to scoring of the sheet metal. The tear strip reinforcing ribs are impressed in a manner so as to take up excess metal generated in such movable tab during scoreline formation; the tautness in the tab sheet metal thus provided facilitates the type of scoreline severing action which is characteristic of the present invention.

Configuration and placement limitations of the prior art retained-tab structures for beverage can end walls limited the length of the opener since, prior to opening, the handle end of an integral opener should, for handling purposes, be within the chime seam periphery; therefore, the mechanical advantage of such retained-tab (FIG. 1) lever action was limited accordingly.

As shown in FIG. 3, the present invention is not similarly constrained. With the configuration and placement provided by the invention, the arcuate scoreline is located contiguous to the chime and the length of the opener can be considerably increased over that available in such prior art. Also, the opening provided is better positioned for pouring or drinking; the pour opening can extend to and beyond the geometric center of the end wall panel to allow ready access of air and smooth pouring from the beginning and throughout removal of contents.

The integral opener can be, as shown in FIG. 3, of a length greater than movable tab 40. The tab opener 52 is positioned with its central longitudinal axis in the same vertical plane as the central longitudinal axis of movable tab 40. A tab opener configuration is taught which facilitates initial rupture and provides an augmented lever action after such initial rupture during opening.

Figure 5:
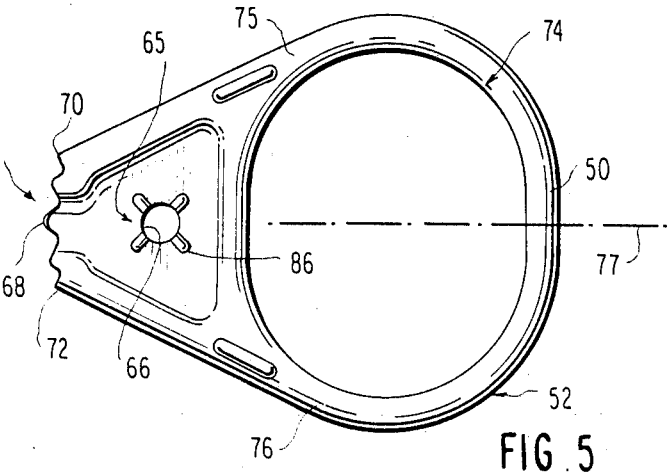
FIG. 5 is a top plan view of the tab opener of the invention.

In the preferred configuration for the tab opener which is shown enlarged in FIGS. 5 and 6, a chisel point 68 is provided for initial rupture of scoreline residual metal at the curvilinear closed end of the U-shaped tab. Initial rupture occurs by Class 1 lever action with the means for securing the tab opener to the movable tab acting as the fulcrum. After such initial rupture, with continued movement of the handle end 52 of the tab opener 50 in a direction away from the external surface of panel 36, pivot points 70, 72 straddle the scored portion contacting the sheet metal of wall panel 36 externally of the periphery of the movable tab 40; pivot points 70, 72 then act as the fulcrum for continued lever action (Class 2); they also prevent insertion of the tab into the can.

The tab opener is formed from flat-rolled sheet metal with handle means, such as ring-pull opening 74, for gripping the opener between the fingers, at its handle end 52 and with sheet metal puncturing means (chisel point 68) at its longitudinally opposite working end 64. The sheet metal between such opposite longitudinal ends of the opener is strengthened along lateral sides 75, 76 (by folded over sheet metal) to provide beam strength inhibiting bending so as to enable full lever action effect.

Means for securing the opener to sheet metal of the movable tab are located between such opposite longitudinal ends and disposed as close as practicable to the working end of the opener to increase lever-action mechanical advantage.

The width at the handle end of opener 52 can be about $\frac{1}{2}$ to $\frac{3}{4}$ of its length with the opener width decreasing in approaching the working end 64. A curvilinear handle opening, such as ring 74, is preferred but other configurations such as that of the handle end of the FIG. 1 prior art opener can be used. The edge sheet metal around the periphery of ring 74, both internally and externally of the opening, is folded over and tucked under to present smoothly rounded metal for finger protection purposes and to strengthen the toroidal ring. Edge metal along lateral side arms 75, 76 which connect the handle end to the working end of the opener is similarly folded over and tucked under.

The opener structure is symmetrical in relation to its central longitudinal axis 77. Chisel point 68 is positioned at working end 64 along such axis 77. The opener securing means, i.e. the unitary rivet means with flattened head 62, is positioned in symmetrical relationship to such axis 77 and is located within the sheet metal panel portion 65 of the opener 52; opener panel 65 is recessed from the upper surface of the opener structure so as to contact sheet metal of the can wall and improve riveting action.

In addition to cutting an aperture 66 for a rivet button in the sheet metal of opener panel 65, a "rosette" is formed about the button opening to provide nodules or indentations such as 86. Flattening of a rivet button is carried out such that sheet metal of the rivet head 62 interlocks with such nodules or indentations to prevent rotation of the tab opener about the rivet button 60; the opener is thus held in the desired orientation with chisel point 68 contiguous to and overlaying tear strip metal at the midpoint (along axis 77) of the arcuate-shaped scoreline 42.

Pivot contact points 70, 72 are spaced laterally from longitudinal axis 77 and positioned as shown in FIGS. 5 and 6.

As seen in FIG. 5, the chisel point 68 protrudes beyond a transverse vertical plane which includes pivot contact points 70, 72. As seen in FIG. 6, chisel point 68 protrudes below (toward the sheet metal panel to be opened) a horizontal plane which includes pivot contact points 70, 72. A sharpened chisel point contact is preferred which, upon lifting of the handle end of the opener, contacts tear strip metal contiguous to the midpoint of the arcuate-shaped scoreline; such chisel point readily ruptures residual scoreline metal with the Class 1 lever action provided.

With continued movement of the handle end of the opener after such initial rupture, pivot points 70, 72 come into contact with the sheet metal wall panel, one on each side of and exterior to the periphery of the movable tab defined by the scoreline means. The fulcrum for the tab opener then shifts to such pivot points 70, 72.

Figure 7:
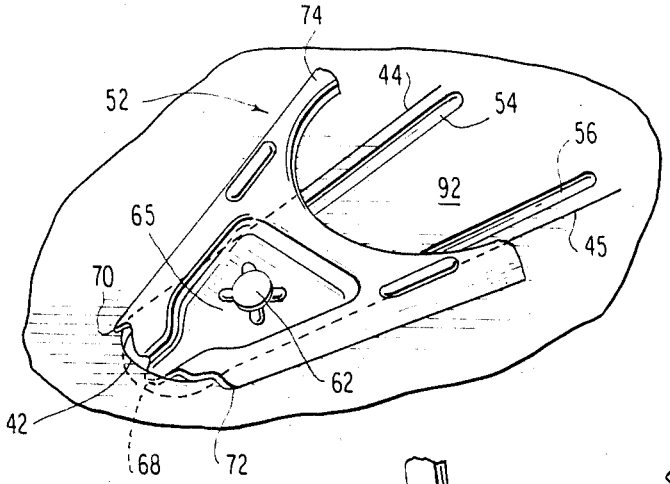
FIG. 7 is a perspective view showing the initial rupture stage in opening a can in accordance with the invention.
Figure 8:
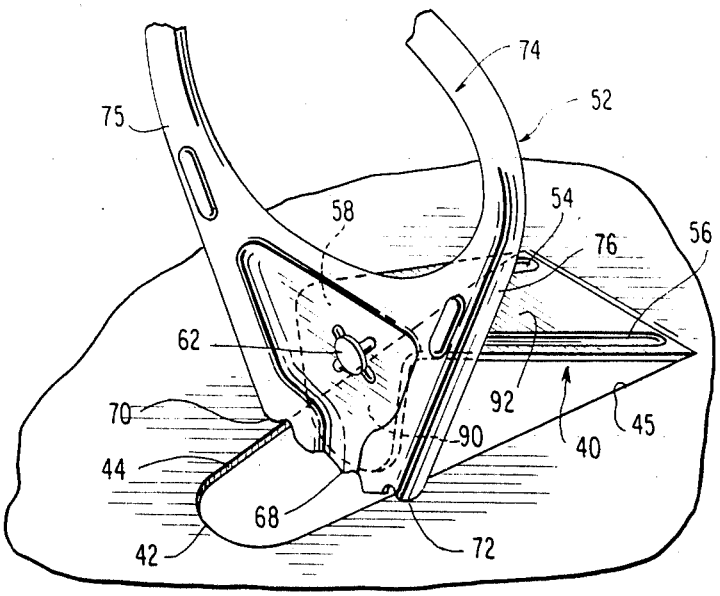
FIG. 8 is a perspective view showing a sequential opening stage to that of FIG. 7.

Initial rupture leading to contact of the pivot points of the opener with the panel sheet metal is shown in FIG. 7. The sheet metal of opener panel 65 and contiguous sheet metal of the movable tab are placed under tension as the handle end of the opener is moved. Initial rupture is by Class 1 lever action about the unitary rivet means which acts as the fulcrum; Class 2 lever action begins with contact of pivot points 70, 72 typically after start of initial rupture. Residual scoreline metal separates along the arcuate-shaped scoreline 42 and can start along scoreline legs 44, 45 with the initial movement as shown in FIG. 7. With continued movement, the movable tab bends about transverse portion 58, the pivot points 70, 72 are in contact with the wall panel and move along such wall panel (exterior to the opening) as shown in FIG. 8. Severance along the full length of the scoreline legs 44, 45 occurs by lever action with the bending action (initial folding) as shown in FIG. 8.

With such initial rupture action of the arcuate scoreline by Class 1 lever action and contact of the pivot points 70, 72 initiating a Class 2 lever action, the bending action of the movable tab about the transverse portion 58 is facilitated by placement of longitudinally-extending reinforcing means; e.g. ribs 54, 56 help establish the bend line contiguous to the unitary rivet means on the side disposed toward the open end of the U-shaped tab. The forward ribs 53, 55 help severance along the scoreline legs and help prevent bending before transverse portion 58, if needed, dependent on the size and placement of the rivet.

The longitudinal sections of the movable tab are angled in relation to the plane of the wall panel; the residual scoreline metal is ruptured to the distal ends of the scoreline legs 44, 45 by lever action by a tearing action which precludes any need for rupturing residual scoreline metal under tension.

In the lever action rupturing, a folding action is initiated at transverse portion 58 between longitudinal sections 90, 92; the relationship between sections 90, 92 during opening is maintained during upward and backward movement as shown in FIG. 9. With continued backward movement, longitudinal section 92 comes into parallel relationship with the wall panel as shown in FIG. 10. Longitudinal section 90 is thus readily folded into its stored position overlapping and substantially parallel to longitudinal section 92 without interruption of such backward movement.

In the position of FIG. 10, the movable tab 40 and opener 52 are stored out of the way of pour opening 94 with both on the exterior surface of the can; longitudinal sections 90, 92 are in overlapping and substantially parallel relationship and are substantially parallel to the plane of the wall panel; the tab opener 52, retained by the sheet metal of the movable tab 40 is also in a plane which is substantially parallel to the plane of the wall panel.

The folded relationship of longitudinal sections of the movable tab (such as sections 90, 92 of tab 40) made available by the invention facilitates ease of placement and storage of the movable tab and opener out of the way of the pour opening 94 (FIG. 10). Also, the desired length opener to make opening easier can be selected. Depending on the dimensional relationships selected and the end wall diameter (typically from about 2 1/16" to 4 4/16") of the can with which the invention is used, the handle end of the opener during storage, after opening, will be within the chime seam or may extend to or beyond the chime periphery; the latter is acceptable because there is no can handling problem after opening. However, with opener configuration and/or length dimension selection, the opener can be stored within the chime periphery in the typical range of can diameters (202 to 404) mentioned. For example, with a twelve (12) fluid ounce beverage can (209), a pour opening which extends at least to the geometric center of the end wall panel (about 1 3/16" in length) can be provided by positioning the transverse fold line at about 10/16" from the closed end of the U-shaped configuration, with an opener having an overall length of about 1 4/16" and the opener will be stored within the chime periphery after opening. Those skilled in the art will be able to determine from the present teachings the dimensional relationship of the scoreline means, folded sections of the movable tab, and the opener to be selected to provide the desired opening and storage characteristics.

In a flat-rolled steel embodiment of the invention for the can indicated, the following gages and measurements can be utilized:

| | 12 fluid ounce carbonated beverage can |
|---|---|
| Flat-rolled steel gage | .010"–.014" |
| Residual scoreline metal thickness | .0025"–.0035" |
| Width of tab 40 at arcuate scoreline 42 | .5" |
| Width of tab 40 at open end 46 | .4" |
| Length of tab 40 | .8" |
| Rivet button 60 diameter | .15" |
| Rivet head 62 diameter | .153" |
| Spacing of rivet center along centerline axis 77 from arcuate scoreline 42 midpoint | .3" |
| Length of reinforcing beading lines 53, 55 | .15" |
| Length of reinforcing beading lines 54, 56 | .4" |
| Reinforcing beading lines: | |
| Depth | .015" |
| Width | .03" |
| Width of tab 40 at transverse portion 58 | .45" |
| Overall length of tab opener 52 | 1.1" |
| Tab opener - flat rolled steel gage | .013 |

-continued

With the above data the principles of the invention can be applied, by those skilled in the can-making art, to larger containers and openings; also to use of flat-rolled aluminum which would typically have a gage between about 0.010" and 0.014" with residual scoreline metal of about 0.0045" to 0.0055".

Specific materials, dimensional, configurational and other aspects have been set forth for purposes of describing the invention; however, for purposes of determining the scope of the invention, reference should be had to the appended claims.

I claim:

1. Easy-access sheet metal wall panel and integral opener structure for a can which provides for Class 1 and Class 2 lever action in severing a portion of such wall panel to provide an opening, comprising a sheet metal wall panel for a can, such wall panel having a predetermined contour, scoreline means of reduced sheet metal thickness defining the scored periphery of an elongated tear strip in the sheet metal wall panel, such tear strip being symmetrical about its central longitudinal axis, an elongated sheet metal opener for severing residual metal of such scoreline means to make such tear strip movable from the predetermined contour of such wall panel, such elongated opener having a working end and a handle end located at opposite longitudinal ends of its central longitudinal axis, and unitary rivet means for securing such elongated opener to such elongated sheet metal tear strip with the central longitudinal axis of such opener overlaying and having the same direction as the central longitudinal axis of such tear strip;

such scoreline means including an arcuate-shaped scoreline defining one longitudinal end of such elongated tear strip and a pair of elongated scoreline legs extending toward the remaining longitudinal end of such elongated tear strip, such centerline longitudinal axis of the elongated tear strip intersecting such arcuate-shaped scoreline substantially at its midpoint, such elongated scoreline legs extending from such arcuate-shaped scoreline, one each on opposite lateral sides of its midpoint, such scoreline legs being spaced laterally from the central longitudinal axis of the tear strip with the major component of direction of each of such pair of scoreline legs being substantially the same as that of the centerline longitudinal axis of such tear strip;

the unitary rivet means joining sheet metal contiguous to the working end of such opener to sheet metal within the scored periphery of such tear strip contiguous to such arcuate-shaped scoreline end of such tear strip, such unitary rivet means being symmetrically disposed in relation to the central longitudinal axis of the elongated sheet metal opener and the centerline longitudinal axis of the elongated tear strip;

such working end of the elongated opener including an initial-contact edge located at its distal end contiguous to its centerline longitudinal axis, and pivot point contact means located in longitudinally recessed relationship to such initial-contact edge including one pivot point contact on each lateral side of such opener in laterally spaced relationship from the central longitudinal axis of such elongated opener;

such elongated opener being secured to sheet metal of the elongated tear strip such that its initial-contact edge is contiguous to and in overlaying relationship to a portion of such sheet metal tear strip which is contiguous to such arcuate-shaped scoreline at its midpoint so as to cause initial rupturing of such arcuate-shaped scoreline by Class 1 lever action upon movement of such opener handle end in an arc in a direction away from the external surface of such wall panel, such unitary rivet means being positioned to act as the fulcrum for such Class 1 lever action during such initial rupture;

such scoreline means being further severed after such initial rupture by contact of such working end pivot point means with wall panel sheet metal externally of such tear strip to cause further severing along such scoreline means by Class 2 lever action with such pivot point contact means acting as the fulcrum for such Class 2 lever action as the handle end of the tab opener is continued to be moved in such arc externally of such can.

2. The structure of claim 1 in which such tear strip further includes shallow-depth profiling formed in the sheet metal of such tear strip providing reinforcing means for such tear strip sheet metal, such reinforcing means for such tear strip sheet metal including longitudinally-extending rib means with the major component of direction of such rib means being substantially the same as that of the centerline longitudinal axis of such tear strip;

such rib means being located along at least a portion of the elongated tear strip from contiguous to such unitary rivet means and extending toward such remaining longitudinal end of such tear strip.

3. The structure of claim 2 in which such wall panel comprises an end wall closure for a beverage can, such end wall closure having a circular configuration with peripheral chime seam metal symmetrically spaced from the geometric center of such wall panel, and such scored periphery of the elongated tear strip defining an elongated tab movable from the contour of such end wall panel, such movable tab having a U-shaped configuration with such arcuate-shaped scoreline located at the closed end of such U-shaped configuration and distal ends of the elongated scoreline legs located at its remaining longitudinally-opposite open end which is unitary with remaining sheet metal of such wall panel such that the elongated U-shaped tab and such integral opener are retained on the end wall closure panel after movement of such tab from the contour of such wall panel to define a pour opening for such can.

4. The structure of claim 3 in which such closed end of the U-shaped movable tab is located on such end wall panel contiguous to such peripheral chime seam metal, with such elongated scoreline legs extending across such end wall panel so as to include such geometrical center therebetween.

5. The structure of claim 3 in which the sheet metal of such end wall panel comprises flat rolled steel having a gage of about 0.010" to 0.014", and in which residual metal of such scoreline means has a thickness of about 0.0025" to 0.0035".

6. The structure of claim 3 in which the sheet metal of such end wall panel comprises flat rolled aluminum having a gage of about 0.010" to 0.015", with such scoreline means having residual metal thickness of about 0.0040" to 0.0055".

7. The structure of claim 3 in which such movable tab includes a portion extending in a direction transverse of such central longitudinal axis of such movable tab which is free of longitudinally-extending rib means, such transversely directed portion being contiguous to such unitary rivet means and disposed longitudinally in relation to such unitary rivet means toward such remaining longitudinally-opposite open end of such elongated tab.

8. The structure of claim 7 including longitudinally-extending rib means extending from such transversely directed portion of such movable tab toward such arcuate-shaped scoreline closed-end of such movable tab.

9. The structure of claim 7 in which such transversely directed portion which is free of longitudinally-directed reinforcing means is located such that two longitudinal sections of the movable tab are established, with one such longitudinal section being located on each longitudinal side of such transverse portion of the movable tab, so that sheet metal of such elongated U-shaped tab is moved from the original contour of the end wall panel to a longitudinally-folded stored position on the exterior of such can by pulling backwardly on such opener handle, after such Class 1 and Class 2 lever action, in a direction toward such open end of such U-shaped tab to move such U-shaped tab away from such pour opening; with such movable tab folded position disposing the such longitudinal sections of the movable tab sheet metal in overlaying relationship to each other and a remaining portion of the external surface area of the end wall panel sheet metal which is exterior to the periphery of the movable tab as defined by such scoreline means.

10. The structure of claim 8 in which such scoreline legs are substantially rectilinear and are substantially parallel to or diverge slightly in relation to such central longitudinal axis in extending from such arcuate scoreline end toward the remaining longitudinally-opposite open end of the U-shaped configuration movable tab.

11. The structure of claim 10 in which such elongated movable tab has a width dimension at its longitudinal midpoint which is about one-third of its length dimension.

12. The structure of claim 10 in which such transverse portion of the movable tab which is free of longitudinally-directed reinforcing means is located about one-third of the longitudinal distance from such closed end of such U-shaped movable tab toward its remaining longitudinally-opposite open end.

13. The structure of claim 10 in which such longitudinally-extending rib means include an elongated rib extending along each such elongated scoreline leg from such curvilinear closed end of such movable tab toward its remaining longitudinally-opposite open end, with such transverse portion of the movable tab which is free of longitudinally-directed reinforcing rib means being defined by an interruption in each such elongated reinforcing rib, such interruption in each such elongated reinforcing rib being in equidistant relationship from such curvilinear closed end of such U-shaped movable tab.

14. The structure of claim 13 further including a laterally-directed reinforcing rib extending in transverse relationship to the central longitudinal axis of such movable tab and located contiguous to such transverse portion of the movable tab which is free of longitudinally-extending reinforcing rib means.

15. The structure of claim 3 in which the elongated sheet metal opener is symmetrical about its central longitudinal axis and has a longitudinal dimension between its working end and handle end which is at least as great as the longitudinal dimension of such U-shaped movable tab.

16. The structure of claim 9 in which the elongated sheet metal opener includes a sheet metal panel portion between its working end and its handle end with the unitary rivet means acting on such panel portion of such opener to secure such opener to such tear strip.

17. The structure of claim 16 in which such Class 1 and Class 2 lever actions cause rupture of such scoreline means of such U-shaped tab to distal ends of such scoreline legs prior to pulling backwardly on such opener handle end toward the longitudinally-opposite open end of such tab.

18. Method for manufacturing easy-access structure to provide for rupture of sheet metal of a can wall panel by Class 1 and Class 2 lever action, comprising providing flat rolled sheet metal, fabricating such sheet metal to provide a wall panel of predetermined contour for a can including the steps of scoring such sheet metal wall panel to establish scoreline means of reduced metal thickness, such scoreline means defining an elongated tear strip which is substantially symmetrical with relation to its centerline longitudinal axis, including an arcuate-configuration scoreline and linearly extended scoreline legs, one on each lateral side of the centerline longitudinal axis for such tear strip, extending from such arcuate-configuration scoreline spaced laterally from the central longitudinal axis of such tear strip with the major component of direction of each such scoreline leg being substantially the same as the major component of direction of such centerline longitudinal axis, profiling such tear strip by impressing elongated reinforcing rib means in such tear strip sheet metal with the major component of direction of such rib means extending longitudinally of such tear strip, such profiling step being carried out simultaneously with such scoring step or in closely timed sequence to such scoring step, providing an elongated sheet metal opener having a working end and a handle end at opposite longitudinal ends of its central longitudinal axis, and securing such opener to the elongated tear strip utilizing sheet metal in a panel portion of such elongated opener contiguous to its working end and sheet metal of the elongated tear strip contiguous to such arcuate-configuration scoreline;

such elongated opener being disposed as secured to such tear strip with its central longitudinal axis extending with its major component of direction being substantially the same as the major component of direction of such centerline longitudinal axis of the elongated tear strip;

such opener working end having an initial-contact edge located contiguous to its central longitudinal axis at its working end for contacting tear strip sheet metal contiguous to such arcuate-configuration scoreline upon movement of the handle end of such opener in a direction away from the external surface of such wall panel to cause initial rupture of such arcuate-configuration scoreline by Class 1 lever action with such means for securing the elongated opener to the elongated tear strip acting as the fulcrum for such initial rupture Class 1 lever action, such elongated opener further including pivot contact means, recessed longitudinally in relation to such initial-contact edge at the working end of such opener, such pivot contact means including a pivot point contact at each side of such opener, spaced laterally from its central longitudinal axis, for contacting sheet metal of the wall panel externally of the elongated tear strip as defined by such scoreline means after such initial rupture at the arcuate-configuration scoreline such that the laterally disposed pivot contact means become the fulcrum for continued lever action rupturing of such scoreline means by Class 2 lever action upon continued movement of the handle end of such opener in an arc externally of such can.

19. The method of claim 18 in which the elongated sheet metal opener is secured to elongated sheet metal tear strip by unitary rivet means, including the steps of forming a rivet button in such sheet metal wall panel at a location disposing such rivet button contiguous to such longitudinal end of the elongated tear strip to be defined by such arcuate-configuration scoreline, such rivet button being formed prior to establishing such scoreline means and reinforcing profile means in such can wall panel, providing an aperture in such panel portion of the elongated opener for receiving such rivet button, placing such aperture over such rivet button, and flattening such rivet button to form a unitary rivet bead which secures such opener to such tear strip.

20. The method of claim 19 in which such profiling step comprises impressing longitudinally-extending reinforcing rib means in sheet metal of such elongated tear strip along each scoreline leg with such reinforcing rib means being interrupted contiguous to such unitary rivet means to present a transverse portion of the tear strip which is free of longitudinally-extending rib means to enable folding of longitudinally distinct sections of the elongated tear strip relative to each other.

* * * * *